United States Patent [19]

Jensen

[11] 4,201,658

[45] May 6, 1980

[54] POUR POINT DEPRESSANT MADE FROM THE ASPHALTENE COMPONENT OF THERMALLY TREATED SHALE OIL

[75] Inventor: Harbo P. Jensen, San Rafael, Calif.

[73] Assignee: Chevron Research Company, San Francisco, Calif.

[21] Appl. No.: 891,566

[22] Filed: Mar. 29, 1978

[51] Int. Cl.[2] ..... C10G 21/00

[52] U.S. Cl. ..... 208/39; 208/14; 208/22; 208/309

[58] Field of Search ..... 208/14, 45, 309, 370, 208/22, 39

[56] References Cited

U.S. PATENT DOCUMENTS

| | | | |
|---|---|---|---|
| 2,204,967 | 6/1940 | Moser | 208/370 |
| 3,284,336 | 11/1966 | Culbertson et al. | 208/11 R |
| 3,532,618 | 10/1970 | Wunderlich et al. | 208/14 |

*Primary Examiner*—Herbert Levine

*Attorney, Agent, or Firm*—D. A. Newell; R. H. Davies; M. K. Bosworth

[57] ABSTRACT

A product useful as a pour point depressant which comprises the asphaltene component of a thermally treated shale oil is disclosed, as is a process for making it, a method for using it and a concentrate and a composition containing it.

2 Claims, 1 Drawing Figure

POUR POINT DEPRESSANT MADE FROM THE ASPHALTENE COMPONENT OF THERMALLY TREATED SHALE OIL

FIELD OF THE INVENTION

This invention relates to pour point depressants and manufacture and use thereof, including use for reducing pour points of petroleum residuum-containing oils and shale oils.

BACKGROUND OF THE INVENTION

High-pour-point residuum-containing oils exposed to low temperatures frequently require an additive to keep them from congealing while they are in storage or being transported. Congelation occurs when the waxy component of the oil crystallizes, and the temperature at which congelation is sufficient to stop flow under ordinary conditions is known as the pour point. Additives or substances that are effective for lowering the pour point are called "pour point depressants". Inexpensive pour point depressants which are effective in small concentrations are always sought after. Various pour point depressants are known and have been used reasonably successfully, mostly with middle-distillate fuels. However, it has been found difficult to obtain a potent pour point depressant for high-pour-point oils and residuum-containing oils such as crude oil or shale oil. A further difficulty is that the influence on the pour point of an oil by any particular substance is unpredictable. This unpredictability is generally thought to be due to structural differences of the waxes occurring in the various oils which are derived from different sources or locations. There exists a need for a potent, inexpensive pour point depressant for petroleum residuum-containing oils and shale oils.

DESCRIPTION OF THE ART

The art discloses various pour point depressants made from shale oil and other sources as well as methods for producing and using these depressants. Use of particular polymers as pour point depressants for residuum-containing oils and heavy petroleum fractions is known; for example, see U.S. Pat. Nos. 3,567,639 and 3,817,866.

U.S. Pat. No. 3,523,071 teaches that the heavier product from visbroken raw shale oil is an effective pour point depressant for hydrodenitrogenated shale oil, but not for raw shale oil.

U.S. Pat. No. 3,532,618 disclosed hydrovisbreading shale oil, and deasphalting the visbroken effluent to produce a deasphalted shale oil of intermediate pour point and an asphaltene portion which is a pour point depressant for shale oil. There is no recognition that the asphaltene component of a shale oil which has not been hydrovisbroken could be effective as a pour point depressant.

U.S. Pat. No. 3,369,992 discloses converting a high-wax, high-pour-point oil into a low-pour-point synthetic crude oil by separating the high-pour-point oil into a virgin distillate and a reduced crude, coking the reduced crude and combining a middle fraction of the coker distillate with the virgin distillate to produce a low-pour-point product.

U.S. Pat. No. 4,029,571 discloses reducing the pour point of a synthetic crude oil by hydrovisbreaking or visbreaking the oil. There is no recognition that the asphaltene component of the thermally treated shale oil may be isolated and used as a pour point depressant.

U.S. Pat. No. 3,738,931 discloses hydrovisbreaking shale oil, separating and hydrogenating the visbroken vapors and combining them with the visbroken liquid to produce shale oil having a reduced pour point.

U.S. Pat. No. 3,284,336 discloses separating shale oil into heavy and light fractions, thermally treating only the heavy fraction at a temperature from 600° F. (316° C.) to below the point of thermal decomposition, and recombining the fractions to give a product having a reduced pour point. Although the pour point of the thermally treated heavy fraction is not changed by the thermal treatment, it is useful as a pour point depressant.

SUMMARY OF THE INVENTION

It has now been discovered that a pour point depressant can be inexpensively produced from a thermally treated full-boiling-range shale oil. In accordance with one embodiment of the present invention, there is provided a product useful as a pour point depressant. This product comprises the asphaltene component of a whole shale oil, which oil has been thermally treated substantially in the liquid phase at a temperature from 600° F. (316° C.) to below the point of significant thermal decomposition for a period of 0.02 to 3 hours.

In accordane with another embodiment of the present invention, there is provided a process for making a product useful as a pour point depressant. This process comprises thermally treating a raw whole shale oil in substantially liquid phase at a temperature from 600° F. (316° C.) to below the point of significant thermal decomposition for a period of 0.2 to 3 hours, thereby forming a thermally treated shale oil; forming a mixture of the thermally treated oil and deasphalting solvent under deasphalting conditions; and separating from said mixture an insoluble asphaltene component, usable as pour point depressant.

In accordance with still another embodiment of the present invention, there is provided a method for lowering the pour point of an oil having a first pour point, which method comprises forming a mixture of a major proportion of said oil with a minor proportion of the asphaltene component of a thermally treated whole shale oil sufficient to provide the mixture with a second pour point substantially lower than said first pour point. Preferably the oil is a shale oil or a fraction of it, although the use of residuum-containing oils, such as coker feedstock, and oils having a pour point in excess of 20° F. (−7° C.), whether derived from petroleum crude, tar sands, coal or oil shale, is within the scope of this invention.

In yet other embodiments, there is provided a pour-point depressant concentrate containing the asphaltene component of a thermally treated whole shale oil, as well as a composition comprising a mixture of a major proportion of an oil having a first pour point and a minor proportion of the asphaltene component of a thermally treated whole shale oil sufficient to provide the composition with a second, substantially lower, pour point.

DETAILED DESCRIPTION

Figure 1:
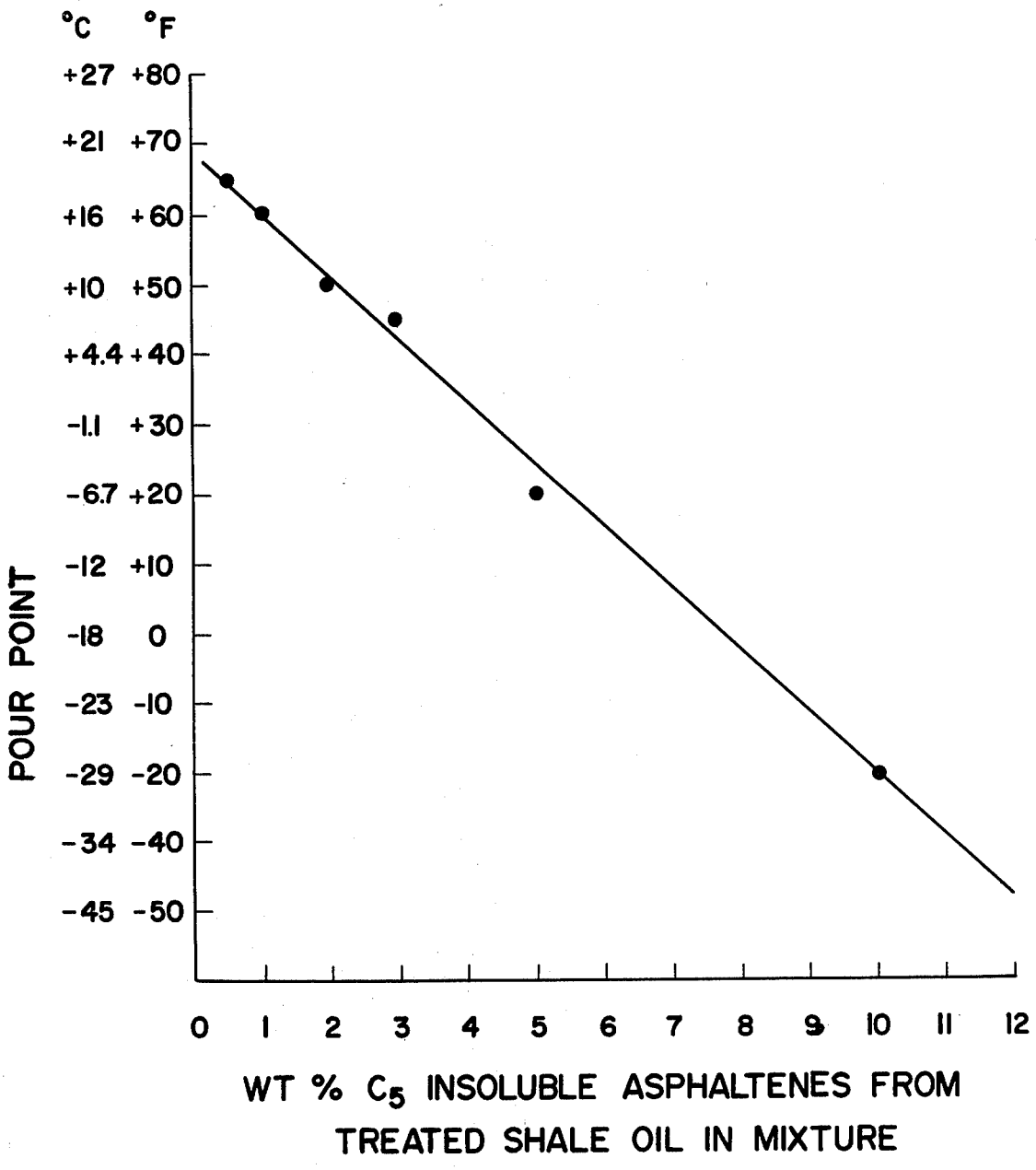
FIG. 1 is a graph which shows the pour point of a mixture of shale oil and the asphaltene component of a thermally treated shale oil versus the weight percent of the asphaltene component in the mixture.

The following terms used in the specification and claims are defined as indicated:

"Raw shale oil" is a shale oil or a fraction thereof recovered from a retorting process, which oil has not subsequently been heated to 600° F. (316° C.) or above.

"Whole shale oil"is a shale oil recovered from a retorting process, from which less than 10 volume percent of the oil has been subsequently removed by a nonhomogeneous separation method such as distillation.

"Thermal treating" is maintaining an oil within a specified temperature range for a specified duration, such that pour point depressant formation occurs, but not so severe that significant thermal cracking or visbreading occurs.

"Major proportion" of an oil means from 99.5 to 75 weight percent, and preferably from 99 to 85 weight percent, of a mixture or composition containing that oil.

"Minor proportion" of a product means from 0.5 to 25 weight percent, preferably from 1 to 15 weight percent, of a composition or mixture containing that product.

"Asphaltene component" of a shale oil means the component of a shale oil which is insoluble in typical deasphalting solvents such as low-molecular-weight hydrocarbons. The preferred deasphalting solvent is an aliphatic hydrocarbon containing from 3 to b 7 carbon atoms.

"Substantially lower pour point" means a pour point at least 10° F. (5.6° C.), preferably 20° F. (11° C.), and still more preferably 30° F. (17° C.) or more, lower than that of the reference oil.

A temperature "below the point of significant thermal decomposition" of the shale oil means that substantially no cracking or visbreaking of the oil will occur, and substantially no (less than 1 or 2% by weight of the oil) methane or ethane gas or elemental carbon will be produced during the thermal treating step. Preferably, the viscosity of a thermally treated shale oil will be at least 85% of that of the raw shale oil, and still more preferably at least 87%.

Feedstocks useful in making the product of the present invention include shale oils derived from any conventional oil shale retorting process, in-situ or aboveground. Conventional retorting processes are carried out by destructive distillation of naturally occurring oil shale at temperatures which usually range from 900° F. to 1300° F. (482° C. to 704° C.). The heat necessary for the retorting may be supplied to the shale by direct combustion within the retort or by indirect heating means such as contact with hot gases or solids. Shale oils derived from conventional retorting processes generally have pour points ranging from 65° F. to 85° F. (18° C. to 29° C.).

The shale oil feedstock must be thermally treated within the specified temperature range for a length of time sufficient to form the pour point depressant (as evidenced by a lower pour point). The range of temperature which may be employed to effect the requisite decrease in pour point in a particular shale oil will range from 600° F. (316° C.) to below the point of significant thermal decomposition of the oil, preferably from 600° F. to 800° F. (316° C. to 427° C.), and still more preferably from 700° F. to 750° F. (371° C. to 399° C.). The thermal treatment is described in more detail in my copending application Ser. No. 891,567, filed Mar. 29, 1978, entitled "Method for Lowering the Pour Point of a Shale Oil", incorporated herein by reference.

The thermal treatment of this invention is to be distinguished from visbreaking and hydrovisbreaking techniques practiced by the prior art. Visbreaking is a pyrolysis treatment of an oil to destroy waxes (paraffins) and high-molecular-weight constituents therein, thus reducing the viscosity of the oil. In visbreaking, considerable cracking is desired and is obtained along with the formation of a substantial amount of coke. In the thermal treatment of this invention, however, little if any cracking or coke formation occurs and the paraffin component of the shale oil is substantially unaffected by the thermal treatment. One distinction between visbreaking and thermal treating is illustrated by the fact that the viscosity of visbroken oil is usually less than 80% and typically about 50% of the viscosity of the feed oil, whereas for a thermally treated oil, the viscosity is at least 85% and preferably at least 87% that of the feed oil. Another distinction is that the boiling range of visbroken shale oil is considerably lower than that of the feed oil, while the boiling range of thermally treated oil does not change significantly.

The thermal treatment will be carried out for a time sufficient to effect a reduction of the pour point of the feedstock. The pour point of the feedstock should be lowered by at least 20° F. (11° C.) and preferably to below +20° F. (−7° C.), and still more preferably below 0° F. (−18° C.). The duration of the thermal treatment will generally be inversely proportional to the temperature at which the thermal treating is carried out, and will generally be for a period of 0.02 to 3 hours, and peferably from 0.08 to 1.5 hours. The thermal treatment may be carried out in an inert atmosphere such as nitrogen or in the presence of hydrogen. The pressure at which the thermal treatment occurs should be sufficient to maintain the oil substantially in the liquid phase, and is generally from 0 to 300 atm. gauge, and preferably from 0 to 100 atm. gauge, and still more peferably from 0 to 30 atm. gauge when hydrogen is not used. If hydrogen is used, the preferred pressure range is from 30 to 100 atm. gauge. The effects of hydrogen are described in my copending application, U.S. Ser. No. 865,352, filed Dec. 28, 1977, entitled "Method for Removing Arsenic from Shale Oil," which is incorporated herein by reference. One advantage of the present invention is that the product may be formed without the addition of hydrogen, although hydrogen will reduce the level of soluble arsenic and iron in the thermally treated oil.

Holding a shale oil in liquid phase within the specified temperature range for the indicated time allows production of a pour point depressant which can be separated as the asphaltene component of the thermally treated shale oil. The product, which is useful as a pour point depressant, is separated from the thermally treated shale oil by any known solvent-deasphalting method. Usually, a liquid deasphalting solvent is mixed with the thermally treated shale oil under deasphalting conditions, for instance a temperature from ambient to about 325° F. (163° C.), preferably from 150°-250° F. (66°-121° C.) and a pressure from atmospheric to 50 atm. gauge, preferably from 1 to 15 atm. gauge. The mixture of thermally treated shale oil and deasphalting solvent is then separated into a first part containing the solvent and a soluble deasphalted shale oil and a second part containing an insoluble asphaltene component, usable as a pour point depressant.

The deasphalting solvent is desirably of relatively low boiling point, so that the solvent can be separated from the deasphalted shale oil by distillation and reused in the deasphalting treatment. The deasphalting solvent may be any known deasphalting solvent, and preferably is an aliphatic hydrocarbon containing from 3 to 7 carbon atoms, and preferably saturated. Especially desirable solvents include, for instance, propane, butane, pentane and hexane. The asphaltenes produced using different solvents may vary in potency regarding pour point reduction. The deasphalting solvent can be contacted with the thermally treated shale oil at a solvent-to-oil ratio of, for instance, 0.2 to 10, and preferably from 0.5 to 5, by volume.

During the thermal-treating step a precipitate containing arsenic and perhaps iron may be formed if the shale oil feedstock contains significant amounts of soluble arsenic or soluble iron.

EXAMPLES

The present invention will be more fully understood by reference to the following Examples. Examples I, II and IV illustrate unsuccessful attempts to produce a pour point depressant in the asphaltene component of shale oil. Example III is an example of the method of the present invention and of the effectiveness of the product thereby produced as a pour point depressant. Example V illustrates the unpredictability of the effectiveness of pour point depressants, Example VI shows the effectiveness of the product of the present invention in lowering the pour point of raw shale oil, while Example VII shows that the pour point of shale oil containing the asphaltene component is stable. Examples VIII and IX illustrate that thermally treating shale oil does not entail significant cracking of the paraffin content thereof, as would be expected from visbreaking or hydrovisbreaking.

EXAMPLE 1

A full-boiling-range raw Colorado shale oil having a pour point of +70° F. (21° C.) was pentane-deasphalted, yielding 1.67 weight percent $C_5$-insoluble asphaltene component. When 2 grams of the $C_5$-insolubles were added to 18 grams of raw shale oil having a pour point of +70° F. (21° C.), the pour point was not lowered. This example shows that the product useful as a pour point depressant is not present in the asphaltene component of the raw shale oil.

EXAMPLE II

U.S. Pat. No. 3,284,336 discloses that when the heavy fraction of a shale oil is thermally treated, a pour point depressant is formed. Since the heavy fraction includes the asphaltene component, a test was run to see if the asphaltene component alone could be thermally treated to give the pour point depressant. A raw whole Colorado shale oil having a pour point of +70° F. (+21° C.) was pentane-deasphalted, yielding 1.67 weight percent of a $C_5$-insoluble asphaltene component. The asphaltenes were then heated by themselves at 750° F. (399° C.) for 1 hour and then cooled. Two grams of thermally treated asphaltenes were then added to 18 grams of raw whole shale oil having a pour point of +70° F. (21° C.). The pour point of the mixture was not lowered. When the deasphalted shale oil (pour point +75° F. [24° C.]) was thermally treated at 700°-750° F. (371°-399° C.), LHSV=1, its pour point was lowered to −55° F. (−48° C.). This example shows that the pour point depressant is not formed from the asphaltene fraction, as would be expected from the teachings of U.S. Pat. No. 3,284,336.

EXAMPLE III

A raw whole Colorado shale oil having a pour point of +65° F. (18° C.) and 1.67% $C_5$-insolubles was thermally treated at 750° F. (399° C.), LHSV=1, over carbon particles, and the pour point was lowered to −50° F. (−46° C.). When the thermally treated oil was pentane-deasphalted, 3.67 weight percent of a $C_5$-insoluble component was removed. When 2 grams of the $C_5$-insolubles were mixed with 18 grams of raw whole shale oil having a pour point of +65° F. (18° C.), the resulting mixture had a −20° F. (−29° C.) pour point. The pour point of the deasphalted thermally treated shale oil was +65° F. (18° C.). This example shows that the $C_5$-insoluble fraction of a thermally treated shale oil contains a product useful as an active pour point depressant, and that only a small amount of the depressant need be added to raw shale oil to significantly lower the pour point.

EXAMPLE IV

Shale oil having a pour point of +70° F. was thermally treated at 750° F. (399° C.) at an LHSV of 1.0. The treated oil was fractionated into 6 fractions, including the residual fraction. Each fraction was then mixed with nine volumes of raw shale oil having a pour point of +70° F. (+21° C.). In no case was the pour point lowered by as much as 5° F. (3° C.). The residual and the two heaviest fractions were combined and added to 9 volumes of raw shale oil, and still no reduction of the pour point occurred. Even though it is known in the art that raw shale oil may be distilled and the heavy fraction thermally treated to produce a pour point depressant, this example shows that the reverse is not true—thermally treating raw shale oil and distilling it to produce a heavy fraction does not give a pour point depressant.

EXAMPLE V

Three percent by weight of the asphaltene fraction of a thermally treated shale oil was added to a Nigerian Forcados residuum oil having a pour point of +95° F. (+35° C.). No decrease in the pour point was observed.

EXAMPLE VI

FIG. 1 shows the results of a study done on the relationship between the concentration of the pour point depressant and the pour point of a mixture of the depressant and a raw shale oil having a pour point of +65° F. (18° C.). The data show an approximately linear relationship between the concentration of $C_5$-insoluble asphaltenes and the pour point of a mixture containing them. Addition of 5 weight percent $C_5$-insoluble asphaltenes lowered the pour point of the mixture to 40° F. (22° C.) below that of the raw shale oil, and addition of 10 weight percent asphaltenes lowered the pour point by 85° F. (47° C.). Thus only a small proportion of the product of the present invention is necessary to significantly lower the pour point.

EXAMPLE VII

A test was conducted to determine the stability of the pour point of a shale oil containing the thermally treated asphaltenes. The initial pour point of the oil was −35° F. (−37° C.), and the pour point after five months of storage at room temperature was −40° F. (−40° C.). This example shows that the pour point will not deteriorate with the passage of time. In contrast, entities in asphaltenes from visbroken oils would be expected to polymerize and thus produce an unstable pour point. This difference in the stability of the pour point shows that visbreaking and thermal treating are different processes which produce different products.

EXAMPLE VIII

A test was run to show that thermally treating shale oil does not lower the pour point by cracking paraffins as would be expected if visbreaking were to occur. A raw whole shale oil was thermally treated at 700° F. (371° C.) at atmospheric pressure and a liquid hourly space velocity of 1. Both the raw whole shale oil and the thermally treated whole shale oil were dialyzed through a rubber membrane with hexane. The rubber membrane allows paraffins in the shale oil to pass through while excluding other components. The raw shale oil yielded 71.8% by weight of dialyzate, and the thermally treated shale oil yielded 73.0% by weight. The dialyzates were then analyzed by GLC wax analysis. The results in Table I show no decrease in the paraffin content and only a 4% decrease in the molecular weight of the paraffins. Thus, the paraffin content of the shale oil was not substantially affected by the thermal treatment. In contrast, the $C_{13}+$ paraffin content of visbroken shale oil would be decreased both in quantity and average molecular weight, which will in turn reduce the pour point.

TABLE I

GLC Wax Analysis of Dialyzate From Raw and Thermally Treated Shale Oils

| | Raw Whole Shale Oil | Thermally Treated Whole Shale Oil |
|---|---|---|
| Dialyzate Yield, Wt. % | 71.8 | 73.0 |
| GLC Analysis of Dialyzate, Wt. % in Whole Oil: | | |
| iso-$C_{13}$ | 0.10 | — |
| n-$C_{13}$ | 0.02 | — |
| iso-$C_{14}$ | 0.57 | — |
| n-$C_{14}$ | 0.06 | 0.02 |
| iso-$C_{15}$ | 1.41 | 0.41 |
| n-$C_{15}$ | 0.12 | 0.10 |
| iso-$C_{16}$ | 1.85 | 1.48 |
| n-$C_{16}$ | 0.18 | 0.28 |
| iso-$C_{17}$ | 2.57 | 2.73 |
| n-$C_{17}$ | 0.25 | 0.31 |
| iso-$C_{18}$ | 3.03 | 3.85 |
| n-$C_{18}$ | 0.24 | 0.33 |
| iso-$C_{19}$ | 3.22 | 4.19 |
| n-$C_{19}$ | 0.23 | 0.42 |
| iso-$C_{20}$ | 2.79 | 3.91 |
| n-$C_{20}$ | 0.26 | 0.41 |
| iso-$C_{21}$ | 2.91 | 3.90 |
| n-$C_{21}$ | 0.20 | 0.39 |
| iso-$C_{22}$ | 2.70 | 3.66 |
| n-$C_{22}$ | 0.24 | 0.38 |
| iso-$C_{23}$ | 2.74 | 3.68 |
| n-$C_{23}$ | 0.24 | 0.35 |
| iso-$C_{24}$ | 2.73 | 3.40 |
| n-$C_{24}$ | 0.19 | 0.27 |

TABLE I-continued

GLC Wax Analysis of Dialyzate From Raw and Thermally Treated Shale Oils

| | Raw Whole Shale Oil | Thermally Treated Whole Shale Oil |
|---|---|---|
| iso-$C_{25}$ | 2.53 | 3.47 |
| n-$C_{25}$ | 0.24 | 0.34 |
| iso-$C_{26}$ | 2.53 | 3.29 |
| n-$C_{26}$ | 0.22 | 0.28 |
| iso-$C_{27}$ | 2.55 | 3.18 |
| n-$C_{27}$ | 0.26 | 0.36 |
| iso-$C_{28}$ | 2.67 | 3.25 |
| n-$C_{28}$ | 0.28 | 0.34 |
| iso-$C_{29}$ | 3.07 | 3.47 |
| iso-$C_{29}$ | 0.37 | 0.47 |
| iso-$C_{30}$ | 2.66 | 2.81 |
| n-$C_{30}$ | 0.25 | 0.30 |
| iso-$C_{31}$ | 2.41 | 2.56 |
| n-$C_{31}$ | 0.17 | 0.23 |
| iso-$C_{32}$ | 2.38 | 2.31 |
| n-$C_{32}$ | 0.14 | 0.15 |
| iso-$C_{33}$ | 1.99 | 1.83 |
| n-$C_{33}$ | 0.06 | 0.07 |
| iso-$C_{34}$ | 1.91 | 1.66 |
| n-$C_{34}$ | 0.05 | 0.05 |
| iso-$C_{35}$ | 1.77 | 1.50 |
| n-$C_{35}$ | 0.02 | 0.03 |
| iso-$C_{36}$ | 1.72 | 1.35 |
| n-$C_{36}$ | 0.01 | 0.04 |
| iso-$C_{37}$ | 2.12 | 1.53 |
| n-$C_{37}$ | 0.12 | 0.09 |
| $C_{38}$ plus | 10.36 | 3.45 |
| Total $C_{37}$- Normal Paraffins | 4.53 | 6.01 |
| Total $C_{37}$- Isoparaffins | 56.93 | 63.42 |
| Total Paraffins | 71.8 | 73.0 |
| Average Molecular Weight | 356 | 341 |

EXAMPLE IX

Another test was run to show that thermally treating shale oil does not lower the pour point by cracking paraffins as would be expected if visbreaking were to occur. A raw shale oil having a +65° F. (+18° C.) pour point was thermally treated at 750° F. (399° C.) at an LHSV=1 to give a thermally treated shale oil having a pour point of −50° F. (−46° C.). The thermally treated oil was deasphalted with pentane, and the resulting deasphalted oil regained its original pour point of +65° F. (+18° C.). This example shows that the pour point reduction in thermally treated shale oil is not caused by thermal cracking of the shale oil.

What is claimed is:

1. A process for making a product useful as a pour point depressant which comprises
   (a) thermally treating a raw whole shale oil in substantially liquid phase at a temperature from 600° F. (316° C.) to below the point of significant thermal decomposition for a period of 0.02 to 3 hours, thereby forming a thermally treated shale oil,
   (b) forming a mixture of said thermally treated shale oil and a deasphalting solvent under deasphalting conditions, and
   (c) separating from said mixture an insoluble asphaltene component, usable as a pour point depressant, and a deasphalted shale oil having a pour point substantially that of said raw shale oil.

2. The process of claim 1 wherein said deasphalting solvent is an aliphatic hydrocarbon containing from 3 to 7 carbon atoms.

* * * * *